US007367451B2

(12) United States Patent
Pendergraph et al.

(10) Patent No.: US 7,367,451 B2
(45) Date of Patent: May 6, 2008

(54) TOOL ACCESSORY CASE HAVING PRODUCT INDICATOR INDICIA SURFACE INSERTS

(75) Inventors: Melvin A. Pendergraph, Arlington Heights, IL (US); Douglas L. Collins, Crystal Lake, IL (US)

(73) Assignee: Robert Bosch GmbH, Stuttgart (DE)

( * ) Notice: Subject to any disclaimer, the term of this patent is extended or adjusted under 35 U.S.C. 154(b) by 398 days.

(21) Appl. No.: 11/072,548

(22) Filed: Mar. 3, 2005

(65) Prior Publication Data

US 2006/0196793 A1 Sep. 7, 2006

(51) Int. Cl.
*B65D 85/20* (2006.01)

(52) U.S. Cl. ..... 206/379; 206/459.5

(58) Field of Classification Search ..... 206/370–379, 206/459.5, 232

See application file for complete search history.

(56) References Cited

U.S. PATENT DOCUMENTS 2,792,935 A * 5/1957 Rocchetti ..... 206/379
2,998,128 A * 8/1961 Larson ..... 206/459.5
3,018,876 A * 1/1962 Huot ..... 206/379
3,804,238 A * 4/1974 Howard ..... 206/459.5
4,936,170 A * 6/1990 Zumeta ..... 206/459.5
5,495,938 A * 3/1996 Bedford et al. ..... 206/371
6,059,108 A * 5/2000 Schiltz, Jr. ..... 206/373
6,994,214 B2 * 2/2006 Yang ..... 206/379
7,165,674 B2 * 1/2007 Pangerc et al. ..... 206/379
7,237,673 B2 * 7/2007 Wikle et al. ..... 206/379
7,264,118 B2 * 9/2007 Chen ..... 206/372
2006/0108246 A1 * 5/2006 Chen ..... 206/379

* cited by examiner

*Primary Examiner*—Bryon P Gehman
(74) *Attorney, Agent, or Firm*—Greer, Burns & Crain, Ltd.

(57) ABSTRACT

A preferred embodiment of the present invention is directed to a tool accessory case having a first and a second housing member pivotally connected to each other along a hinge portion and forming a tool holding cavity. At least one of the first and second housing members has a window from the outside of the case to the cavity. At least one insert is configured for receiving at least one tool accessory, the insert being disposed in at least one of the housing members. The insert has an identifier surface configured to be exposed through the window of the case. On the identifier surface, a product indicator is disposed for identifying the type of tool accessory insert disposed within the tool accessory case.

20 Claims, 4 Drawing Sheets

TOOL ACCESSORY CASE HAVING PRODUCT INDICATOR INDICIA SURFACE INSERTS

FIELD OF THE INVENTION

The present invention is related to tool accessory cases.

BACKGROUND OF THE INVENTION

Tool accessory cases are commonly used by consumers and individuals in many professions to organize small parts such as drill bits, fasteners, screw driver bits, saw blades, spade bits and the like. Frequently, accessories of this sort are available in sets of varying size and shape and are used for different purposes. It is desirable to keep the accessories organized so that the user can easily locate the specific tool accessory for the particular purpose.

The tool accessories are commonly organized in individual compartments within the tool accessory case in order of size and type. The compartments retain the tool accessory while also permitting the user to easily select and remove the tool accessory from the compartment.

In the conventional tool accessory case, the type of tool accessory stored in the compartments is not apparent from the outside of the case. Typically, the tool accessory case must be opened to see its contents. Requiring the user to open the tool accessory case to determine the type of tool accessories is inconvenient, particularly if the user has multiple tool accessory cases to open to locate a specific tool accessory.

SUMMARY OF THE INVENTION

A preferred embodiment of the present invention is directed to a tool accessory case having a pair of housing members pivotally connected to each other along a hinge portion and forming a tool holding cavity. At least one of the housing members has a window from the outside of the case to the cavity. At least one insert is configured to receive at least one tool accessory, the insert being disposed in at least one of the housing members. The insert has an identifier surface which is visible in the window of the case, and which has a product indicator identifying the type of tool accessory insert that is disposed within the case.

In another embodiment of a tool accessory case, the housing member has at least one case formation, and the insert has at least one insert formation configured to engage the case formation to retain the insert in the housing member. The insert is removably disposed in the housing member.

Another feature of the present invention is directed to an insert for a tool accessory case, wherein the tool accessory case has a pair of housing members pivotally connected to each other along a hinge portion, the housing members forming a tool holding cavity, and at least one of the members has a window from the outside of the case to the cavity. The insert is a tray member configured to receive at least one type of tool accessory and be removably disposed and retained in at least one of the housing members. The tray member has an identifier surface visible in the window when the tray member is disposed in said housing member. The identifier surface has a product indicator that identifies the type of tool accessory to be received by the tray.

DETAILED DESCRIPTION

Figure 1:
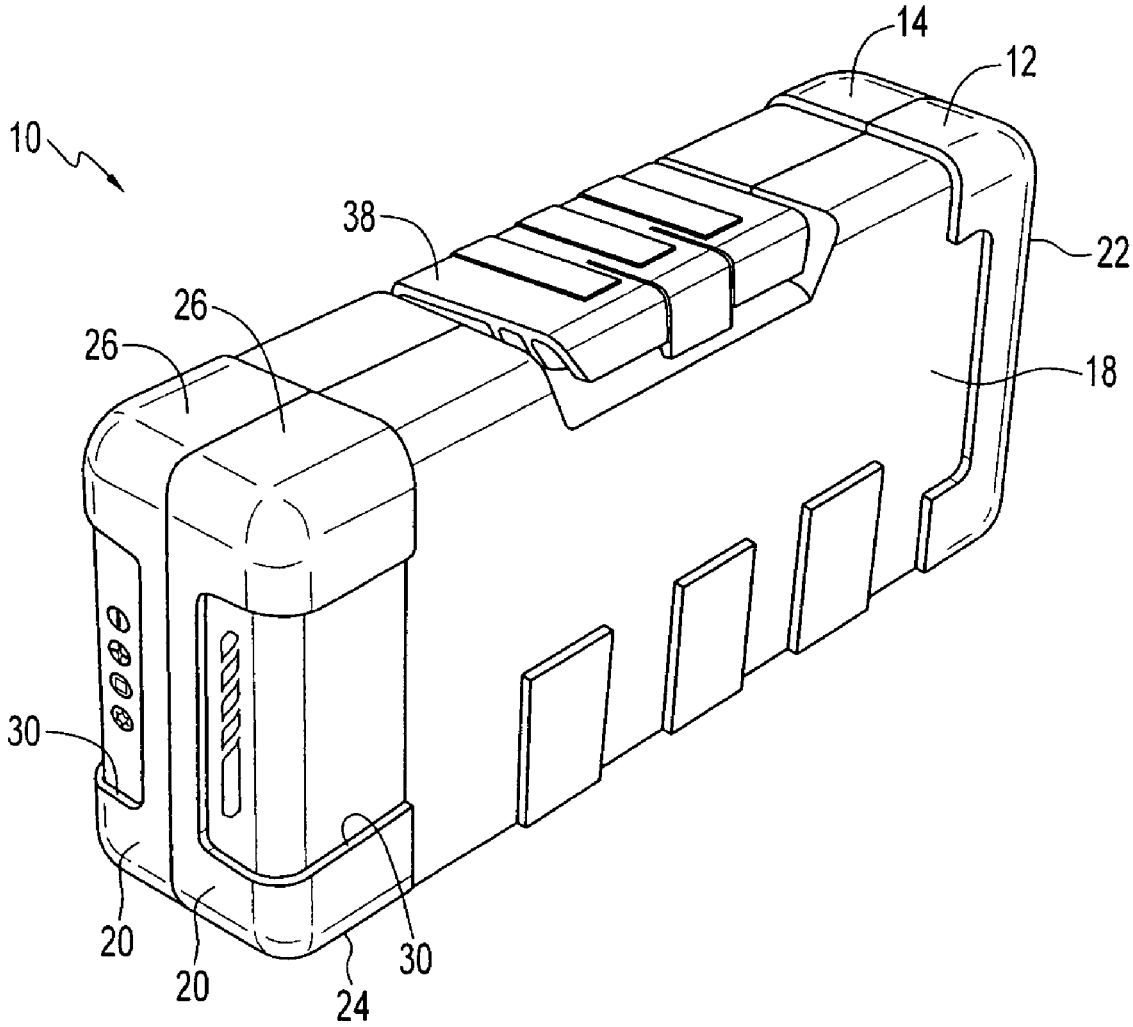
FIG. 1 is a perspective view of a tool accessory case in the closed position and having a plurality of windows and a plurality of inserts disposed therein.

Turning now to the drawings, and particularly to FIG. 1, a tool accessory case, indicated generally at 10, is shown to have a generally rectangular housing having first and second housing members 12, 14 in which elongated tool accessories 16 can be stored. Each housing member 12, 14 preferably includes a base 18 with two short sides 20, 22, a hinged side 24 and a top side 26 defining a tool holding cavity 28 (FIG. 2) therein, as is known in the art. At least one window 30 to the cavity 28 is formed in the case 10. In the preferred embodiment, the window 30 is formed in the case 10 at the base 18 and the short side 20 (FIG. 3), although other locations are contemplated. Preferably, the accessory case 10 is made of molded plastic, but other materials may be used.

Figure 2:
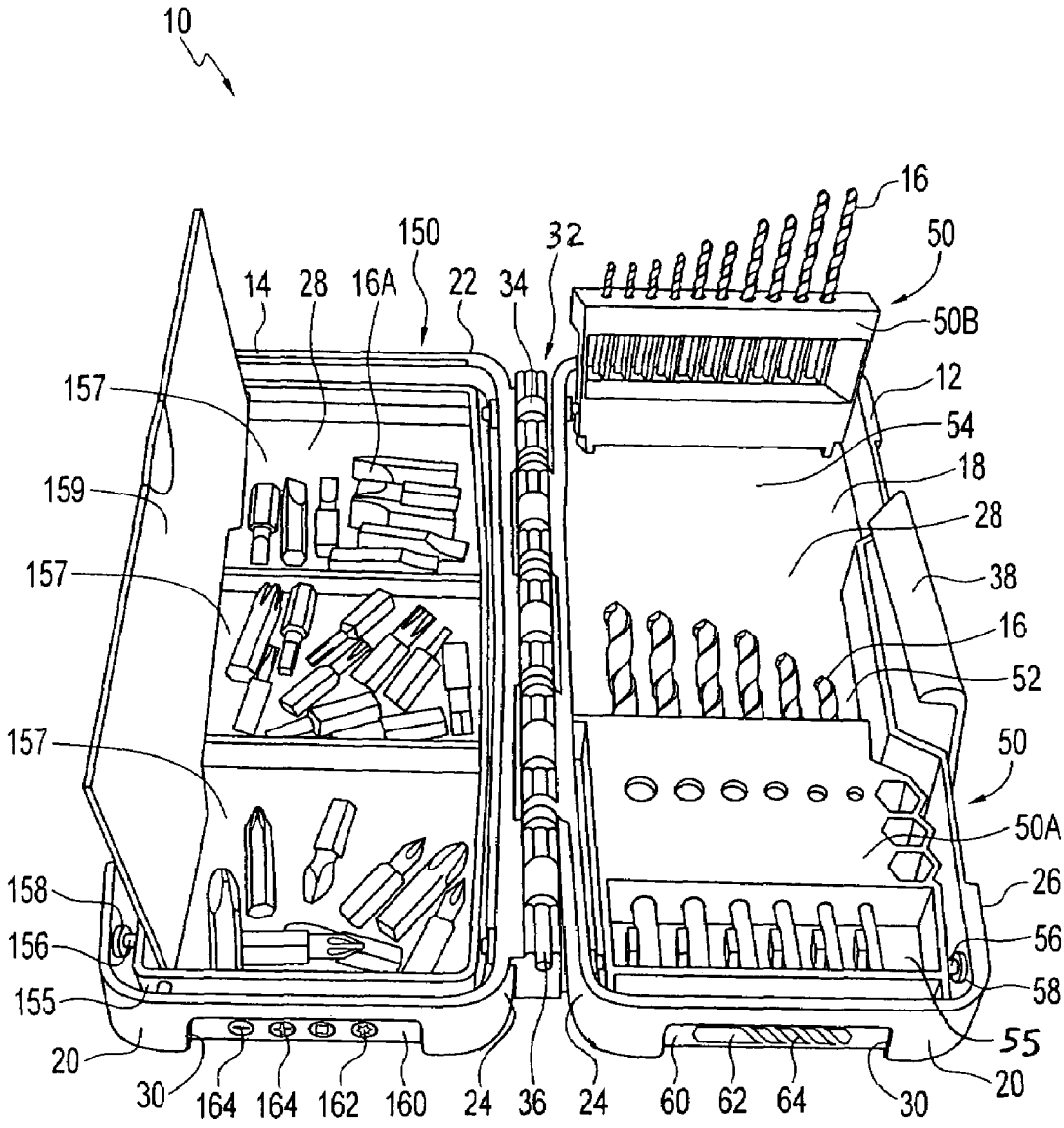
FIG. 2 is a perspective view of the tool accessory case of FIG. 1 in an open position with a screw driver bit insert and a plurality of drill bit inserts.

Referring now to FIG. 2, the hinged side 24 of the housing members 12, 14 are pivotally connected to each other along a hinge 32, which permits the housing members to open and close with respect to each other. The hinge 32 is preferably an integrally formed sleeve 34 with a rod 36 disposed therein, however other hinge designs are contemplated. A latch 38 is configured to maintain the case 10 in a closed position.

A detailed description of the preferred latch is disclosed in U.S. patent application Ser. No. 11/062,373, entitled "Latch for Tool Accessory Case", filed Feb. 22, 2005, which is incorporated by reference herein.

At least one insert 50 is preferably pivotally disposed in the first housing member 12 and is configured to receive tool accessories 16, such as drill bits, for example. More preferably, the housing member 12 has a first insert 50A disposed in a first portion 52 of the housing member and a second insert 50B disposed in a second portion 54 of the housing member. The first and second inserts 50A and 50B each preferably hold more than one of the tool accessories 16.

Still referring to FIG. 2, the insert 50 is preferably a tray member 55 dimensioned to fit within the housing members 12, 14. However, the tray member 55 can have any size, shape and configuration which permits the tray member to be housed in the cavity of the case 10 and which is configured to receive tool accessories 16.

Figure 3:
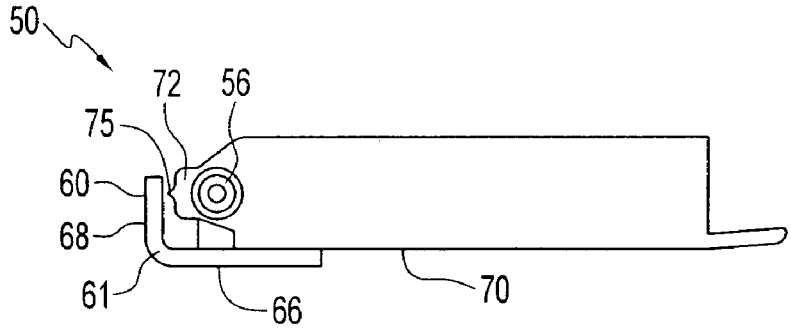
FIG. 3 is a side view of the drill bit insert of FIG. 2.
Figure 4:
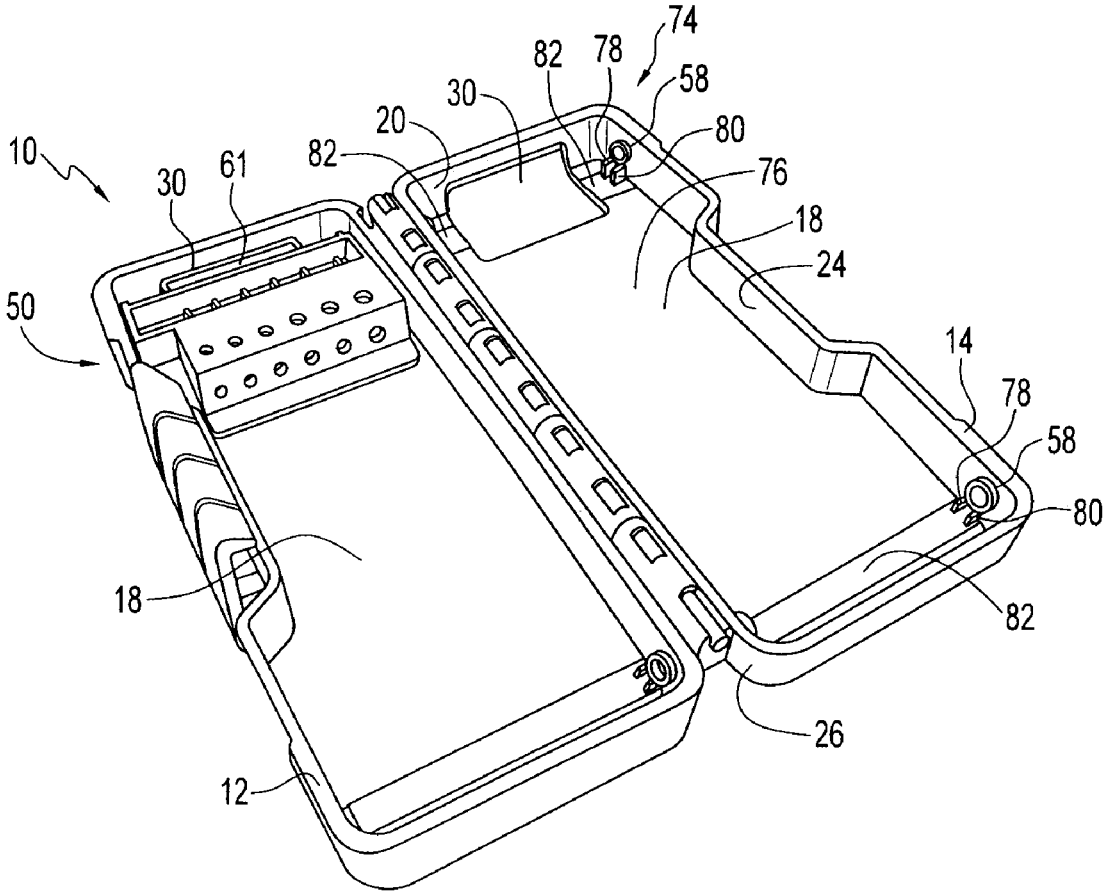
FIG. 4 is a perspective view of a tool accessory case in the open position with one of the housing members having an insert removed.

Referring now to FIGS. 2-4, the inserts 50 are preferably pivotally disposed in the housing member 12, such as by pressure fitting an insert formation 56, preferably a pin, in a case formation 58, preferably a collar, although other means of attachment are contemplated. The case formation 58 is preferably disposed in the side 24, 26 or the base 18 of the housing member 12. In this configuration, the insert 50 can be pivoted generally between zero and 90-degrees. When the tool accessories 16 are stored in the tool accessory case 10, the insert 50 is pivoted to have a generally parallel alignment with the base 18 to permit the housing members 12, 14 to close with respect to each other and define the cavity 28.

Further detailed description of the insert 50 is disclosed in U.S. patent application Ser. No. 11/063,015, entitled "Tool Accessory Case Index", filed Feb. 22, 2005, which is incorporated by reference herein.

When the insert 50 is in the stored position, and further, when the case 10 is closed, at least one identifier surface 60 of the insert 50 is exposed through the window 30 of the case 10. Preferably, the identifier surface 60 is disposed on a raised, generally "L"-shaped tongue 61 of the insert 50. Two tongue surfaces 66, 68 are generally flush with the base 18 and the short side 20, respectively (See FIG. 1), when the insert is generally parallel with the base. When the insert 50 is pivoted generally 90-degrees from the base 18, the surface 68 of the tongue 61 is generally flush with the base 18. In the preferred embodiment, the identifier surface 60 is on the surface 68, however the identifier surface may also be on the surface 66, both surfaces, or any other surface of the insert which is exposed through the window 30.

The "L"-shaped tongue 61 is preferably integrally formed with the insert 50 and extends from a bottom side 70 of the insert 50. Cantilevered from the bottom side 70, the tongue 61 curves upward, generally perpendicular to the bottom side such that the geometry of the tongue generally coincides with the geometry of the window 30. The configuration of the window 30 at the base 18 and the short side 20 permits the tongue 61 to freely pivot within the housing member 12, 14 without being impeded by the structure of the case 10. In turn, the raised nature of the tongue 61 permits the insert 50 to be generally flush with the outside surface of the case 10 in both the generally parallel and generally perpendicular positions. While a generally "L"-shaped tongue 61 is preferred, other shapes and configurations are contemplated for providing an identifier surface 60 to be exposed through the window 30. Further, it is contemplated that the tongue 61 can be used with any embodiment of insert.

The insert 50 pivots at the insert formation 56 (preferably a pin) within the case formation 58 (preferably a collar). To retain the insert 50 at a generally 90-degree orientation with respect to the base 18, a leg 72 is extended from the insert and is configured to engage a retaining structure 74 disposed in an interior surface 76 of the housing member 12, 14. The leg 72 is preferably a rounded structure with a rounded projection 75 on the end, although other configurations are contemplated. Further, the leg 72 is preferably integrally molded with the insert 50 and generally resilient.

In the preferred embodiment, the retaining structure 74 includes first and second protrusions 78, 80, spaced apart on the interior surface of the base 18 and the side 24, 26. The retaining structure 76 also includes a detent 82 preferably disposed generally transversely on the base 18 and located generally at the first and second protrusions 78, 80. The protrusions 78, 80 are preferably rib-like structures having a general slope from the side wall 24, 26 to the base 18.

When the insert 50 is pivoted, the leg 72 pivots and engages the first protrusion 78. When the insert 50 is pivoted further, the leg 72 generally deforms until the leg, and more specifically, the projection 75, clears the protrusion 78 and nests between the first and second protrusions 78, 80 in the detent 82. The second protrusion 80 resists pivoting of the insert generally beyond 90-degrees. Further, pivoting generally beyond 90-degrees is impeded by the engagement of the insert 50 against the side 20 of the case 10 (FIG. 2). Other configurations of retaining structure 74 are also contemplated, such as providing a resilient retaining structure and a non-resilient leg 72, incorporating a spring, or by changing the size, shape and alignment of either the leg or the retaining structure.

A product indicator 62 is preferably molded into the insert 50 at the identifier surface 60. In the preferred embodiment, the indicator 62 is a drill bit icon 64, although any other indication of the contents of the case 10 is contemplated. Other indicators 62 may include words, symbols, drawings, color-coding, or a viewing window to the inside of the case, among other things. Further, the indicator 62 may be painted on the identifier surface 60, attached to the surface, or applied to the identifier surface by any other means. The indicator 62 may also be the color of the insert 50, each type of insert having a different color corresponding to the type of tool accessory 16. In the pivoting configuration of the insert 50, the identifier surface 60 is preferably visible through the window 30 throughout the range of pivot.

A second embodiment of an insert for a tool accessory 16A is generally similar to the first embodiment 50 and is designated generally at 150. Similar components with the first embodiment are designated with corresponding reference numbers in the 100-series.

The insert 150 is disposed in the second housing member 14, such as by being pressure fit. At least one insert formation 156 and at least one case formation 158 cooperate to maintain the insert 150 within the case, although any means of retaining the insert in the case is contemplated. The case formation 158 can be the inner surface of the housing member 14 and the insert formation 156 can be any formation on the insert 150 that permits the insert to nest inside the housing member 14.

The insert 150 is preferably a bin-shaped tray member 155 configured to be disposed within the cavity 28 formed by the second housing member 14 of the case 10. Within the insert 150, at least one, and preferably a plurality of compartments 157 are arranged to hold the tool accessories 16A. At least one lid 159 is preferably pivotally disposed over at least one compartment 157 to maintain the tool accessories 16A in the compartment. Although the tool accessories 16A are depicted as screw driver bits, it is contemplated that any tool accessories can be housed in the insert 150. Further, any number and arrangement of compartments 157 within the insert 150 are contemplated.

An identifier surface 160 of the insert 150 is exposed through the window 30 of the second housing member 14. Similar to the first insert 50, a product indicator 162 is disposed on the identifier surface 160. In the second insert 150, however, the product indicator 162 is preferably a plurality of screw driver bit icons 164, while other product indicators are contemplated. Further, a single screw driver bit icon 164 is contemplated.

Figure 5:
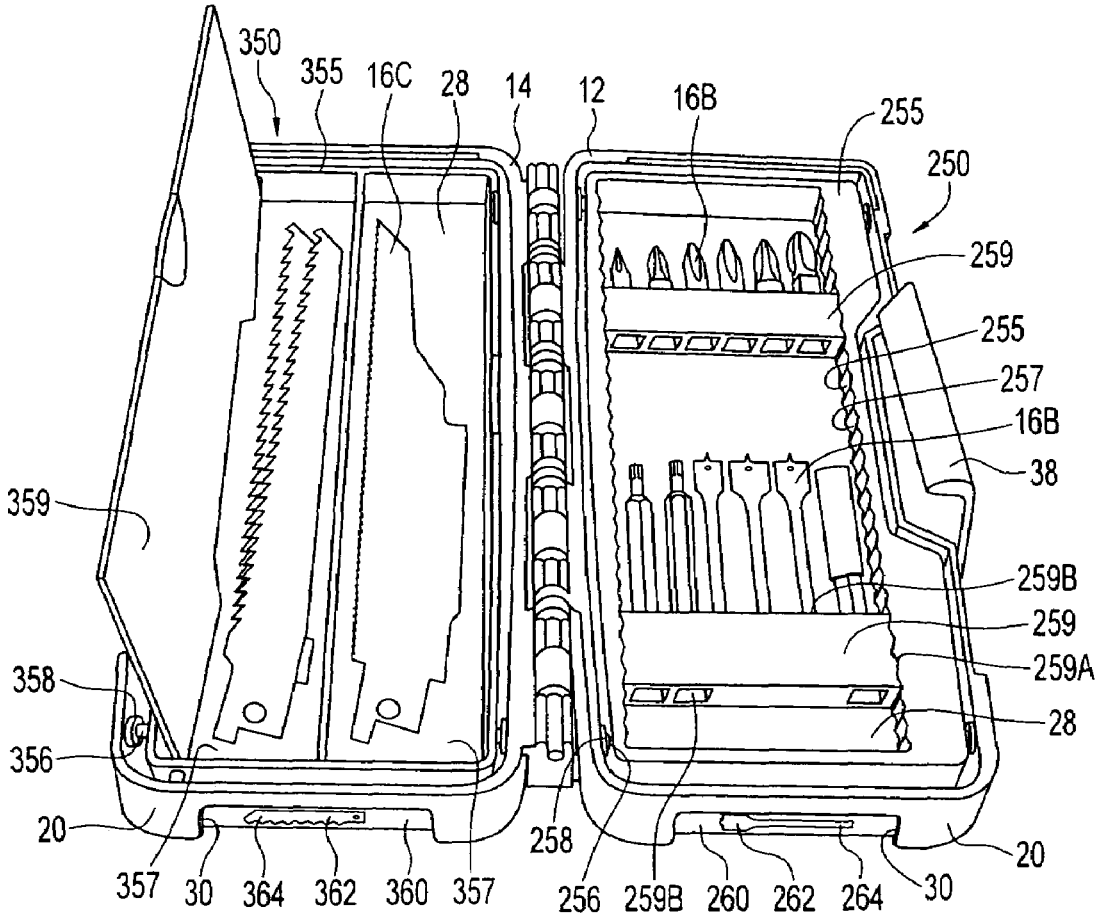
FIG. 5 is a perspective view of the tool accessory case of FIG. 1 in an open position with a saw blade insert and a screw driver and spade bit insert.

Shown in FIG. 5 is the third embodiment of the insert for a tool accessory 16B, which is generally similar to the previous embodiments 50, 150 and is designated generally at 250. Similar components with the first embodiment are designated with corresponding reference numbers in the 200-series.

Similar to the second insert 150, the insert 250 is preferably pressure fit into the first housing member 12. Preferably, at least one insert formation 256 and at least one case formation 258 positively retain the insert 250 in the case, although any means of retaining the insert in the case is contemplated. The insert 250 is preferably a bin-shaped tray member 255 that is sized and shaped to be disposed within the cavity 28 of the first housing member 12.

On at least one inside surface 255 of the insert 250, serrated edges 257 are configured to engage and retain a bit holder 259 within the insert 250. The bit holder 259 has complementary serrated edges 259A which are configured to adjustably dispose the bit holder within the tray member 255 at a selected location.

The bit holder 259 preferably has bit holder openings 259B, generally either a throughbore or a counterbore, which permit the tool accessories 16B to be retained in the bit holder. Although the tool accessories 16B are depicted as screw driver bits and spade bits, it is contemplated that any tool accessories 16 can be housed in the insert 250. Further, any number and arrangement of bit holders 259 within the insert 250 are contemplated.

Similar to the previous embodiments 50, 150, a product indicator 262 is disposed on an identifier surface 260 of the insert 250. The identifier surface 260 and the product indicator 262 are exposed through the window 30 of the first housing member 12. In the third insert 250, the product indicator 262 is depicted as a spade bit icon 264, while other product indicators are contemplated depending on the type of tool accessory 16 the insert 250 is configured for. Additionally, more than one product indicator can be disposed on any embodiment of insert.

Still referring to FIG. 5, a fourth embodiment of the insert for a tool accessory 16C is generally similar to the previous embodiments 50, 150, 250 and is designated generally at 350. Similar components with the index 50 are designated with corresponding reference numbers in the 300-series.

The insert 350 is preferably pressure fit into the second housing member 14 with at least one insert formation 356 and at least one case formation 358 to positively retain the insert 350 in the case, although any means of retaining the insert in the case is contemplated. The insert 350 is preferably a bin-shaped tray member 355 that is configured to be disposed within the cavity 28 of the second housing member 14.

Within the insert 350, at least one, and preferably a plurality of compartments 357 are arranged to hold tool the accessories 16C. Further, at least one lid 359 is preferably pivotally disposed over at least one compartment 357 to maintain the tool accessories 16C in the compartment. Although the tool accessories 16C are depicted as saw blades, it is contemplated that any tool accessories can be housed in the insert 350. Further, any number and arrangement of compartments 357 within the insert 350 are contemplated.

On an identifier surface 360, a product indicator 362 is configured to be exposed through the window 30 of the second housing member 14. In the insert 350, the product indicator 362 is preferably a saw blade icon 364, while other product indicators are contemplated.

The inserts 50, 150, 250 and 350 are configured to be and interchangeably disposed in the case 10 through at least one insert formation 56, 156, 256 and 356, and at least one case formation 58, 158, 258 and 358. Further, any combination of inserts 50, 150, 250 and 350 can be disposed in either of the first and second housing members 12, 14. In this manner, the case 10 is configured to be universal for the interchangeable inserts 50, 150, 250 and 350, which can be customized for the user's needs. The product indicators 62, 162, 262 and 362 indicate which inserts 50, 150, 250 and 350, and thus which tool accessories 16, 16A, 16B and 16C, are disposed in the case 10 without requiring the user to open the case 10. Further, the inserts 50, 150, 250 and 350 can be configured to be removably disposed in the housing members 12, 14. Alternatively, the inserts 50, 150, 250 and 350 can be fixed in the housing members 12, 14.

It is also contemplated that more than one insert 50, 150, 250 and 350 can be removably disposed in each of the first and second housing members 12, 14. Further, it is contemplated that any style of insert for any tool or tool accessory 16 can be configured to be inserted into the universal case 10 and provided with a product indicator configured to be exposed through the window 30 for identifying the contents of the case.

While various embodiments of the present invention have been shown and described, it should be understood that other modifications, substitutions, and alternatives are apparent to one of ordinary skill in the art. Such modifications, substitutions and alternatives can be made without departing from the spirit and scope of the invention, which should be determined from the appended claims.

Various features of the invention are set forth in the following claims.

What is claimed is:

1. A tool accessory case comprising:

first and second housing members pivotally connected to each other along a hinge portion, said housing members forming a tool holding cavity, at least one of said first and second housing members having a window from outside the case to said cavity;

at least one insert configured to receive at least one tool accessory, said at least one insert being disposed in at least one of said housing members, said at least one insert having at least one identifier surface configured to be exposed through said window, said at least one insert having at least one inside surface at least partially defining an insert cavity, wherein at least one accessory holder is selectively disposed in said insert cavity along said at least one inside surface; and a product indicator disposed on said at least one identifier surface for identifying the type of tool accessory insert disposed within the tool accessory case.

2. A tool accessory case according to claim 1 wherein at least one of said first and second housing members has at least one case formation configured to receive at least one insert formation of said at least one insert to retain said at least one insert in the case, wherein said at least one case formation and said at least one insert formation are configured to be pressure fit together.

3. A tool accessory case according to claim 1 wherein said at least one inside surface has a serrated edge, and said at least one accessory holder is engageable with said serrated edge selectively along said at least one inside surface.

4. A tool accessory case according to claim 3 wherein said at least one accessory holder has an edge having a complementary shape to said serrated edge to engage said serrated edge of said at least one inside surface.

5. A tool accessory case according to claim 1 wherein said product indicator comprises an icon of the at least one tool accessory which is configured to be received by said at least one insert.

6. A tool accessory case according to claim 1 wherein said product indicator comprises a color corresponding to the at least one tool accessory which is configured to be received by said at least one insert.

7. A tool accessory case according to claim 1 wherein said product indicator comprises at least one word corresponding to the at least one tool accessory which is configured to be received by said at least one insert.

8. A tool accessory case according to claim 1 wherein said product indicator comprises a drawing of the at least one tool accessory which is configured to be received by said at least one insert.

9. A tool accessory case according to claim 1 wherein said first and second housing members are formed of molded plastic.

10. A tool accessory case according to claim 1 wherein said at least one identifier surface is a raised surface.

11. A tool accessory case according to claim 10 wherein said at least one insert is pivotally disposed in said housing members.

12. A tool accessory case comprising:

first and second housing members pivotally connected to each other along a hinge portion to be pivotable to an open position and a closed position, said first and second housing members having substantially the same shape and forming a tool holding cavity, at least one of said first and second housing members defining at least one window from outside the case to said cavity, said at least one of said first and second housing members having at least one case formation;

at least one insert configured to receive at least one tool accessory, said at least one insert being disposed in said at least one of said first and second housing members, said at least one insert having at least one identifier surface exposed through said at least one window and having at least one insert formation configured to engage said at least one case formation to removably retain said at least one insert in said at least one of said first and second housing members, wherein said at least one insert is pivotable from a first position generally parallel with a base of said at least one of said first and second housing members, to a second position generally perpendicular to said base, wherein an insert pivot axis extends between a hinged side of said at least one of said first and second housing members to a side opposite of said hinged side, wherein when said at least one insert is in said first position, said at least one tool accessory can be stored in said at least one insert both parallel with the base and perpendicular with the base;

a product indicator disposed on said at least one identifier surface for identifying the type of tool accessory insert disposed within the tool accessory case, wherein said product indicator is viewable through said at least one window when said first and second housing members are in said open position and said closed position, and when said at least one insert is in said first position and said second position.

13. A tool accessory case of claim 12 wherein said at least one insert comprises a plurality of inserts interchangeable with at least one of said first and second housing members.

14. A tool accessory case according to claim 12 wherein said product indicator comprises an icon of the at least one tool accessory which is configured to be received by said at least one insert.

15. A tool accessory case according to claim 12 wherein said product indicator comprises a color corresponding to the at least one tool accessory which is configured to be received by said at least one insert.

16. A tool accessory case according to claim 12 wherein said product indicator comprises at least one word corresponding to the at least one tool accessory which is configured to be received by said at least one insert.

17. A tool accessory case according to claim 12 wherein said product indicator comprises a drawing of the at least one tool accessory which is configured to be received by said at least one insert.

18. A tool accessory case comprising:

first and second housing members pivotally connected to each other along a hinge portion to be pivotable to an open position and a closed position, said first and second housing members having substantially the same shape and forming a tool holding cavity, at least one of said first and second housing members defining at least one window from outside the case to said cavity, said at least one of said first and second housing members having at least one case formation;

at least one insert configured to receive at least one tool accessory, said at least one insert being disposed in said at least one of said first and second housing members, said at least one insert having at least one identifier surface viewable through said at least one window and being generally flush with said at least one of said first and second housing members, wherein said at least one identifier surface has at least one insert formation configured to engage said at least one case formation to removably retain said at least one insert in said at least one of said first and second housing members, and said identifier surface is generally flush with said at least one of said first and second housing members to form an exterior surface of the case;

a product indicator disposed on said at least one identifier surface for identifying the type of tool accessory insert disposed within the tool accessory case, wherein said product indicator is viewable through said at least one window when said first and second housing members are in said open position and said closed position.

19. The tool accessory case of claim 18 wherein said at least one of said first and second housing members have a generally rectangular base, a first side, a second side, a third side and a hinged side, and said at least one window is defined by said base and at least one of said first side, second side, third side and hinged side.

20. The tool accessory case of claim 19 wherein the insert has a insert base and a first insert side, a second insert side, a third insert side and a fourth insert side, and wherein said at least one identifier surface is disposed at both said insert base and at least one of said first insert side, second insert side, third insert side and fourth insert side, and said identifier surface is generally flush with said at least one of said first and second housing members.

* * * * *